US011005199B2

(12) United States Patent
Hou et al.

(10) Patent No.: US 11,005,199 B2
(45) Date of Patent: May 11, 2021

(54) ELECTRICAL PLUG CONNECTOR AND ELECTRICAL RECEPTACLE CONNECTOR

(71) Applicant: Advanced Connectek Inc., New Taipei (TW)

(72) Inventors: Pin-Yuan Hou, New Taipei (TW); Wen-Hsien Tsai, New Taipei (TW); Shuang-Xi Xiao, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 16/116,498

(22) Filed: Aug. 29, 2018

(65) Prior Publication Data

US 2019/0074616 A1 Mar. 7, 2019

(30) Foreign Application Priority Data

Sep. 1, 2017 (CN) ..... 201710777054.2

(51) Int. Cl.

| | |
|---|---|
| ***H01R 13/627*** | (2006.01) |
| ***H01R 13/659*** | (2011.01) |
| ***H01R 12/71*** | (2011.01) |
| ***H01R 12/58*** | (2011.01) |
| ***H01R 13/05*** | (2006.01) |
| ***H01R 12/73*** | (2011.01) |

(Continued)

(52) U.S. Cl.

CPC ..... *H01R 12/716* (2013.01); *H01R 12/585* (2013.01); *H01R 12/7064* (2013.01); *H01R 12/73* (2013.01); *H01R 13/055* (2013.01); *H01R 13/113* (2013.01); *H01R 13/627* (2013.01); *H01R 13/6275* (2013.01); *H01R 13/631* (2013.01); *H01R 13/639* (2013.01); *H01R 13/6593* (2013.01); *H01R 13/6581* (2013.01)

(58) Field of Classification Search

CPC ..... H01R 13/629; H01R 12/7005; H01R 13/6593

See application file for complete search history.

(56) References Cited

U.S. PATENT DOCUMENTS 6,071,141 A * 6/2000 Semmeling ..... H01R 13/6275 439/353
6,257,914 B1 * 7/2001 Comerci ..... H01R 13/6273 439/357

(Continued)

*Primary Examiner* — Felix O Figueroa

(57) ABSTRACT

An electrical plug connector has an insulated housing, two elastic buckle elements, multiple plug terminals, and a plug metallic shell. The insulated housing has a terminal portion and two connecting portions. The two elastic buckle elements are respectively mounted in receiving grooves of the two connecting portions of the insulated housing. Multiple plug terminals are arranged on the terminal portion of the insulated housing. An electrical receptacle connector is detachably connected with the electrical plug connector. The electrical receptacle connector has a receptacle insulated housing and multiple receptacle terminals. The receptacle insulated housing has an inserting portion and two receptacle connecting portions. The multiple receptacle terminals are mounted in a mounting slot of the receptacle insulated housing. When the electrical plug connector is connected with the electrical receptacle connector, the multiple plug terminals may contact the multiple receptacle terminals and are conducted.

15 Claims, 9 Drawing Sheets

(51) Int. Cl.

| | |
|---|---|
| ***H01R 13/639*** | (2006.01) |
| ***H01R 13/11*** | (2006.01) |
| ***H01R 12/70*** | (2011.01) |
| ***H01R 13/631*** | (2006.01) |
| ***H01R 13/6593*** | (2011.01) |
| *H01R 13/6581* | (2011.01) |

(56) References Cited

U.S. PATENT DOCUMENTS

| | | | | |
|---|---|---|---|---|
| 6,814,605 | B2 * | 11/2004 | Masumoto | H01R 23/6873 439/353 |
| 6,966,789 | B2 * | 11/2005 | Takaku | H01R 13/6275 439/353 |
| 7,192,297 | B1 * | 3/2007 | Wu | H01R 12/592 439/358 |
| 7,252,531 | B2 * | 8/2007 | Wu | H01R 13/6275 439/358 |
| 7,410,382 | B2 * | 8/2008 | Wu | H01R 13/6275 439/358 |
| 7,934,938 | B2 * | 5/2011 | Bandhu | H01R 13/6275 439/352 |
| 8,303,326 | B1 * | 11/2012 | McKee | H01R 13/6275 439/358 |
| 10,312,617 | B2 * | 6/2019 | Wang | H01R 12/77 |

* cited by examiner

ELECTRICAL PLUG CONNECTOR AND ELECTRICAL RECEPTACLE CONNECTOR

BACKGROUND OF THE INVENTION

1. Field of the Invention

The instant disclosure relates to a connector, and more particularly to an electrical plug connector that is coupled to a coaxial cable or a flexible flat cable (FFC) and an electrical receptacle connector that is mounted on a circuit board or a flexible printed circuit (FPC).

2. Description of Related Art

An electrical plug connector and an electrical receptacle connector are used to connect different electrical components. The electrical plug connector is coupled to a coaxial cable or a flexible flat cable (FFC), and the electrical receptacle connector is mounted on a circuit board or a flexible printed circuit (FPC). Therefore, the coaxial cable may be electrically connected with the circuit board.

However, after the conventional electrical plug connector is inserted into the electrical receptacle connector, the conventional electrical receptacle connector needs a ring-shaped buckle to connect with the conventional electrical plug connector to secure the connection between the conventional electrical receptacle connector and the electrical plug connector. However, the conventional electrical receptacle connector and the conventional electrical plug connector have the following drawbacks.

First, there is no guiding device between the conventional electrical plug connector and the conventional electrical receptacle connector. Therefore, a user has to align the conventional electrical plug connector and the conventional electrical receptacle connector carefully.

Second, after the conventional electrical plug connector is inserted into the conventional electrical receptacle connector, the user needs to lock the buckle, and this is inconvenient for the user.

Third, the ring-shaped buckle is an independent component from the electrical receptacle connector. Therefore, the whole structure is complicated, and the cost cannot be reduced.

Fourth, the electrical receptacle connector may be used in environments with electromagnetic interference (EMI) and radio frequency interference (RFI), but the conventional electrical receptacle connector is not effective in preventing the aforementioned interference.

SUMMARY OF THE INVENTION

The instant disclosure is to provide an electrical plug connector and an electrical receptacle connector that can be easily mutually mating and dissembled from each other with a guiding mechanism.

In view of this, an embodiment of the instant disclosure provides an electrical plug connector which has an insulated housing, two elastic buckle elements, multiple plug terminals, and a plug metallic shell. The insulated housing has a terminal portion and two connecting portions integrally formed as a single part. The two elastic buckle elements are respectively mounted wholly in receiving grooves of the two connecting portions of the insulated housing. The multiple plug terminals are mounted at the terminal portion of the insulated housing. An electrical receptacle connector is detachably connected with the electrical plug connector. The electrical receptacle connector has a receptacle insulated housing and multiple receptacle terminals. The receptacle insulated housing has an inserting portion and two receptacle connecting portions. The multiple receptacle terminals are mounted in a mounting slot of the receptacle insulated housing. When the electrical plug connector is connected with the electrical receptacle connector, the multiple plug terminals may contact the multiple receptacle terminals and are electrically connected.

Other objects, advantages, and novel features of the instant disclosure will become more apparent from the following detailed description when taken in conjunction with the accompanying drawings.

DETAILED DESCRIPTION OF PREFERRED EMBODIMENT

Figure 1:
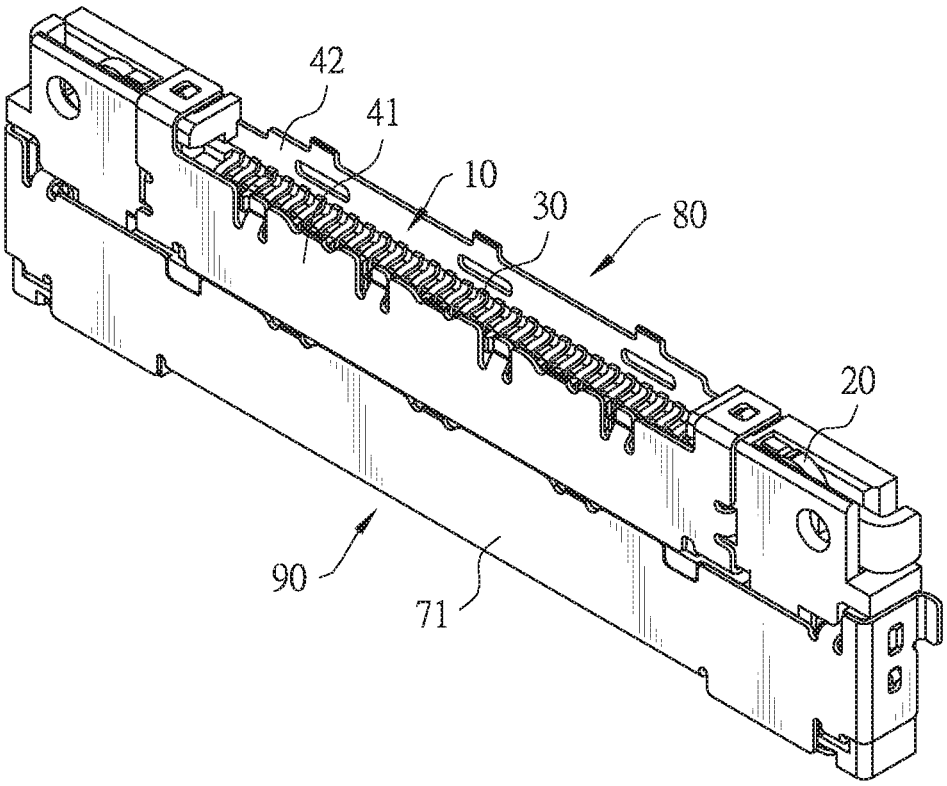
FIG. 1 is a perspective view of an electrical plug connector and an electrical receptacle connector in accordance with the instant disclosure.
Figure 2:
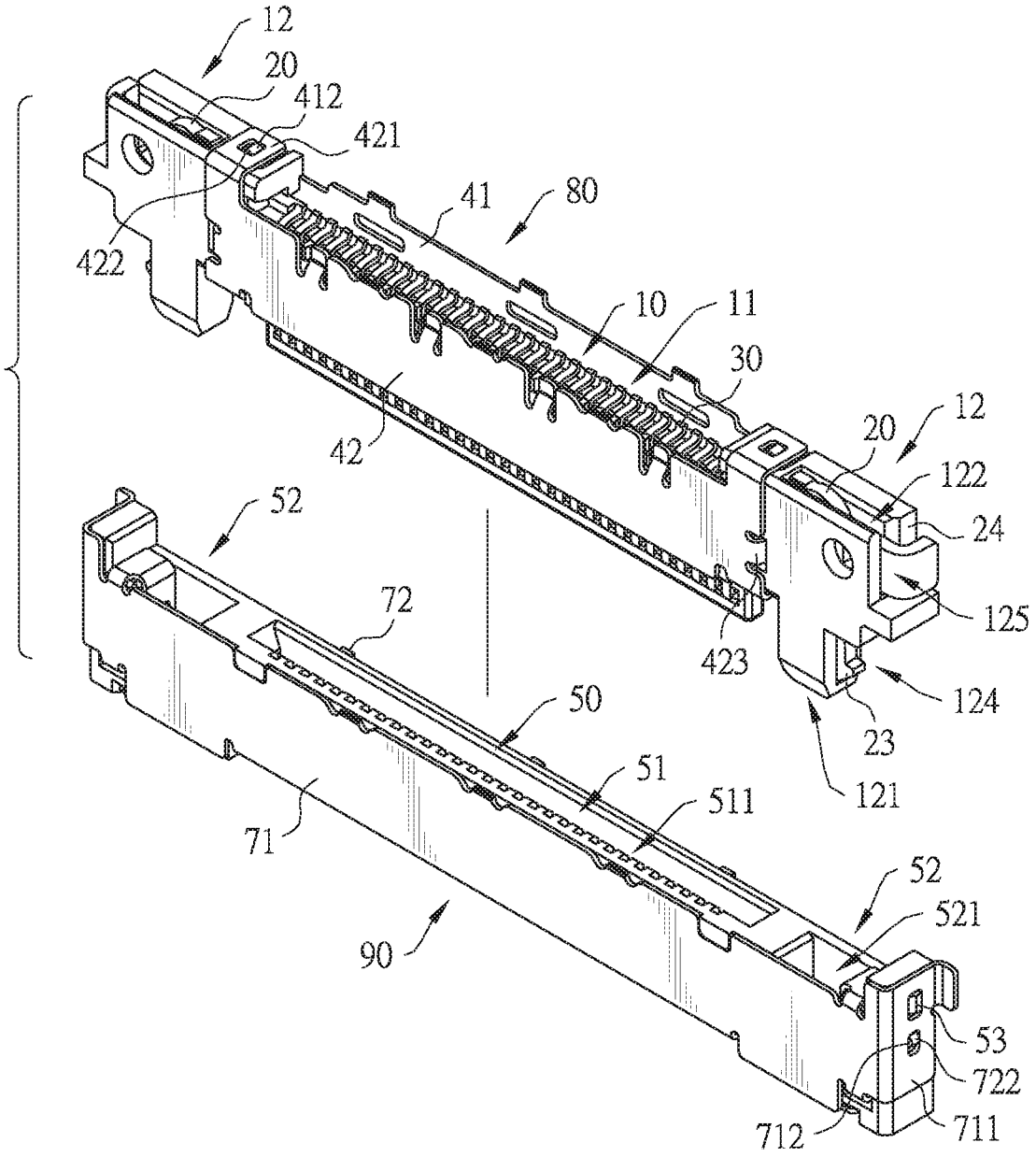
FIG. 2 is an exploded perspective view of the electrical plug connector and the electrical receptacle connector in FIG. 1.
Figure 3:
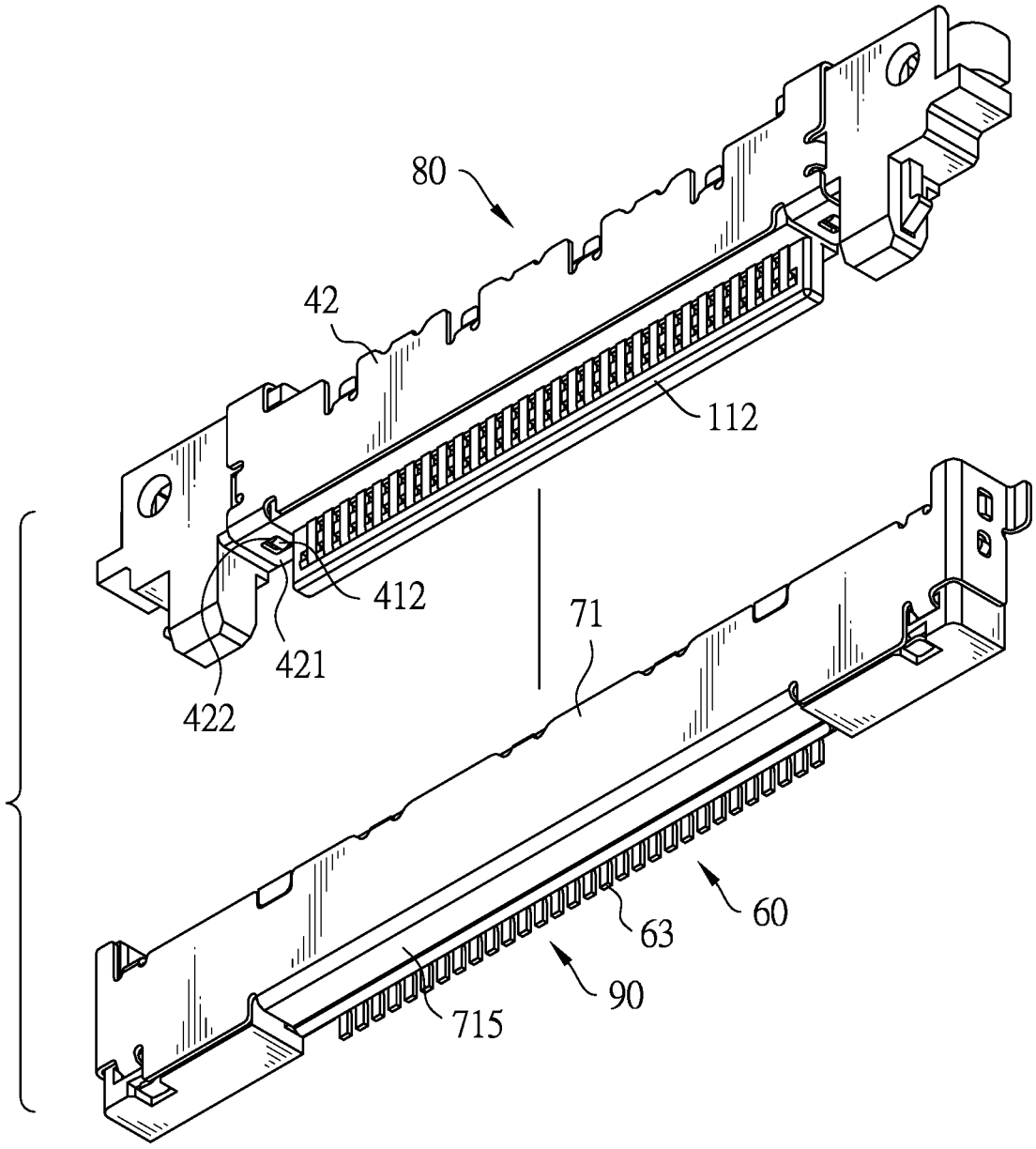
FIG. 3 is another exploded perspective view of the electrical plug connector and the electrical receptacle connector in FIG. 1.

Referring to FIGS. 1 and 2, the instant disclosure provides an electrical plug connector 80 and an electrical receptacle connector 90. With reference to FIGS. 2 to 5 and 9, the electrical plug connector 80 has an insulated housing 10, two elastic buckle elements 20, multiple plug terminals 30, and a plug metallic shell.

The insulated housing 10 has a terminal portion 11 and two connecting portions 12 which are formed in long-and-thin shapes. The terminal portion 11 is formed in a long-and-thin shape. The terminal portion 11 includes a base portion 111, a tongue portion 112, a first end portion 113 and a second end portion 114. The tongue portion is extended from a lower side of the base portion 111 and is exposed to an exterior of the insulated house 10. The first end portion 113 and the second end portion 114 of the terminal portion 11 are respectively defined at two lateral portion of the terminal portion 11. The two connecting portions 12 are respectively formed at the first end portion 113 and the second end portion 114 of the terminal portion 11, such that the two connecting portion 12 and the terminal portion 11 are integrally formed as a single part. Each connecting portion 12 has a guiding pillar 121. The guiding pillar 121 protrudes from a bottom surface of the connecting portion 12. The guiding pillars 121 of the connecting portions 12 are respectively parallel to two sides of the tongue portion 112 and are respectively disposed apart from the tongue portion 112 at the lateral sides of the base portion 111. Preferably, each guiding pillar 121 is a rectangular pillar. Each guiding pillar 121 has four inclined faces formed at a bottom surface of the guiding pillar 121, and this makes the guiding pillar 121 tapered from the top to the bottom. Therefore, the four inclined faces of each guiding pillar 121 can provide a guiding effect. The shape of each guiding pillar 121 is not limited to a rectangle; for instance, the bottom of each guiding pillar 121 may be a hemisphere.

Figure 9:
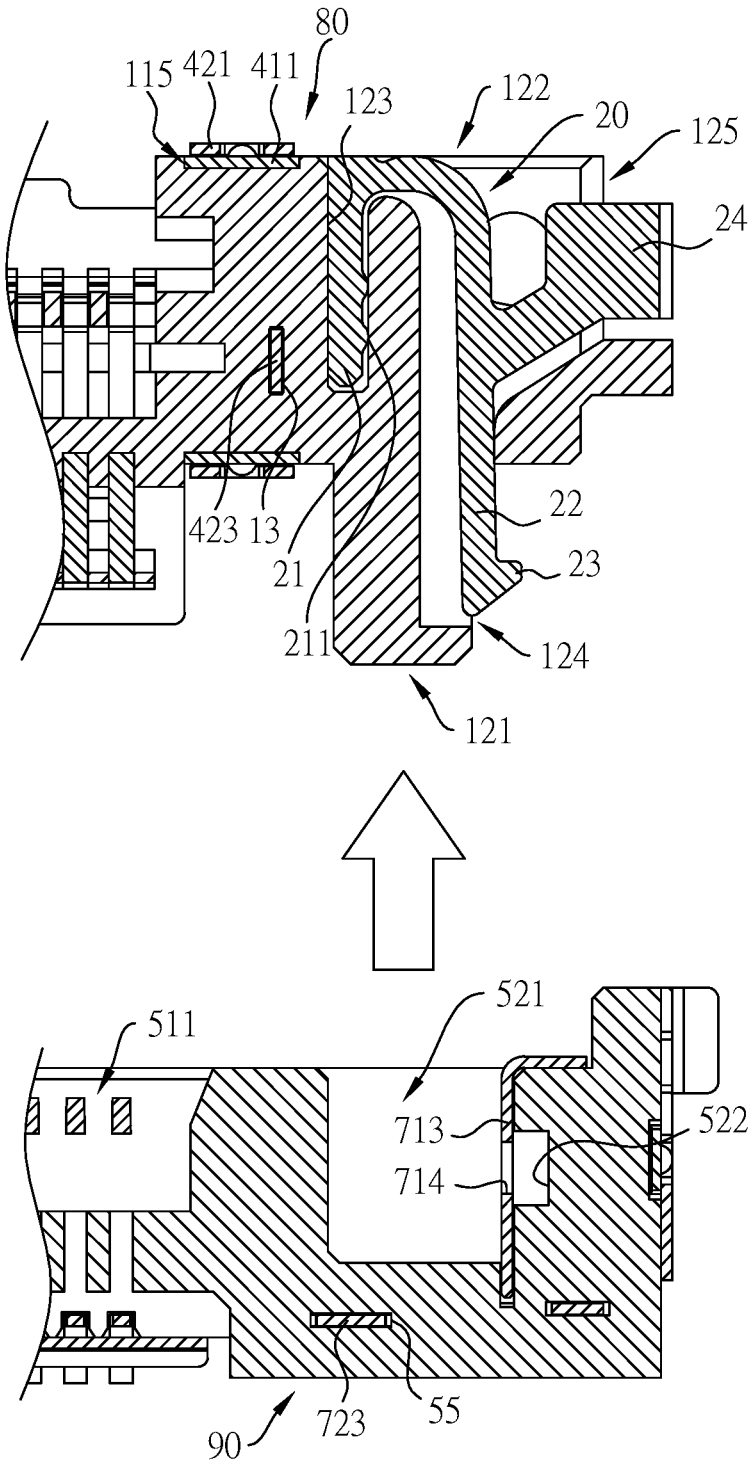
FIG. 9 is an enlarged exploded operational cross sectional side view of the electrical plug connector and the electrical receptacle connector in FIG. 1.

Each connecting portion 12 has a receiving groove 122 and a fixing groove 123 (as shown in FIG. 9), and the receiving groove 122 and the fixing groove 123 are formed in a top surface of the connecting portion 12. The receiving groove 122 extends to the internal space of the guiding pillar 121. The guiding pillar 121 has a side surface and an opening 124, and the opening 124 is formed through the side surface of the guiding pillar 121 and communicates with the receiving groove 122. In this embodiment, the opening 124 is formed on the outer side surface of the guiding pillar 121. The opening 124 is not limited to be formed on the outer side surface of the guiding pillar 121 and can be formed on the front or the back side surface of the guiding pillar 121.

The two elastic buckle elements 20 are respectively mounted wholly in the receiving grooves 122 of the two connecting portions 12. Each elastic buckle element 20 has a fixed portion 21, a moving portion 22, an engaging portion 23, and a pressing portion 24. Each elastic buckle element 20 is a metal stamping component. Each elastic buckle element 20 is formed from a single flat metal plate by metal stamping process and the fixed portion 21, the moving portion 22 and the engaging portion 23 are a thin and flat structure or thin and flat shape. The fixed portion 21 is mounted at the corresponding connecting portion 12. In this embodiment, the fixed portion 21 is mounted through the fixing groove 123. The fixed portion 21 has a side surface and multiple abutting protruding portions 211, and the multiple abutting protruding portions 211 protrude from the side surface of the fixed portion 21 transversely. The multiple abutting protruding portions 211 abut an inner surface of the fixing groove 123, and this makes the fixed portion 21 stably mounted at the connecting portion 12.

A top end of the moving portion 22 extends from a top end of the fixed portion 21. The moving portion 22 can be pressed and moved toward the fixed portion 21. The engaging portion 23 horizontally extends from a bottom end of the moving portion 22. The engaging portion 23 selectively protrudes out from the opening 124 of the guiding pillar 121 according to the position of the moving portion 22. The fixed portion 21, the moving portion 22 and the engaging portion 23 lie in a same plane. The fixed portion 21, the moving portion 22 and the engaging portion 23 of each of the elastic buckle element 20 have the same thickness in a thickness direction being perpendicular to said plane. In this embodiment, the engaging portion 23 transversely extends from a bottom of the moving portion 22, and this makes the engaging portion 23 protrudes out of the opening 124 of the guiding pillar 121.

Each connecting portion 12 has a notch 125 formed through a side surface of the connecting portion 12. Each notch 125 communicates with a corresponding receiving groove 122. The pressing portion 24 of each elastic buckle element 20 horizontally protrudes form an outer side surface of the moving portion 22, and extends out of the corresponding notch 125. Therefore, a user may press the moving portion 22 via the pressing portion 24, and the moving portion 22 and the engaging portion 23 are moved toward the fixing groove 123. In another embodiment, there is no pressing portion 24, the moving portion 22 directly extends out of the connecting portion 12, and a user may press the moving portion 22 directly.

The multiple plug terminals 30 are arranged on the terminal portion 11 along a longitudinal direction of the terminal portion 11 so as to form multipolar shapes at appropriate pitch intervals. In detail, the multiple plug terminals 30 are arranged between the first end portion 113 and the second end portion 114. The long-and-thin shaped terminal portion 11 is extending in a long-and-thin shape along the multipolar arrangement direction (the connector longitudinal direction) of the multiple plug terminals 30. The multiple plug terminals 30 include at least one signal terminal and at least one ground terminal. In another embodiment, the multiple plug terminals 30 include at least one power supply terminal.

The base portion 111 of the insulated housing 10 is covered by the plug metallic shell. In this embodiment, the plug metallic shell includes a first metallic shell 41 and a second metallic shell 42. The insulated housing 10 is covered by the first metallic shell 41 from above and the second metallic shell 42 from below, but the tongue portion 112 and the two connecting portions 12 of the insulated housing 10 and two elastic buckle elements 20 is are exposed to the exterior of the insulated housing 10 and are uncovered by the plug metallic shell.

The first metallic shell 41 has two side ends, two first positioning sheets 411, and two first positioning blocks 412. Each first positioning sheet 411 protrudes from a respective one of the two side ends toward the insulated housing 10. The two first positioning sheets 411 are bent to form upper and lower sides of the first metallic shell 41 respectively. Each positioning block 412 protrudes from a top surface of a respective one of the first positioning sheets 411. Moreover, two assembling grooves 115 are formed in the top and bottom of the first end portion and second portion, respectively. The first position sheets are respectively received in the assembling grooves 115.

The second metallic shell 42 has two side ends, two second positioning sheets 421, and two second positioning holes 422. Each second positioning sheet protrudes from a respective one of the two side ends toward the insulated housing 10. The two second positioning sheets 421 are bent to form upper and lower sides of the second metallic shell 42 respectively. Each second positioning hole 422 is formed through a respective one of the second positioning sheets 421. Each second positioning hole 422 is disposed around a respective one of the positioning blocks 412 of the first metallic shell 41. Therefore, the first metallic shell 41 and the second metallic shell 42 can be combined together.

The insulated housing 10 further has two insertion slots 13, and the two insertion slots 13 are formed in a side surface of the insulated housing 10 that faces the second metallic shell 42. In detail, the insertion slots are formed in the side surfaces of the first end portion 113 and the second end portion 114. The second metallic shell 42 has two clamping sheets 423 protruding from an inner surface of the second metallic shell 42. The two clamping sheets 423 are respectively mounted in the two insertion slots 13, such that the second metallic shell 42 is combined with the insulated housing 10.

Figure 4:
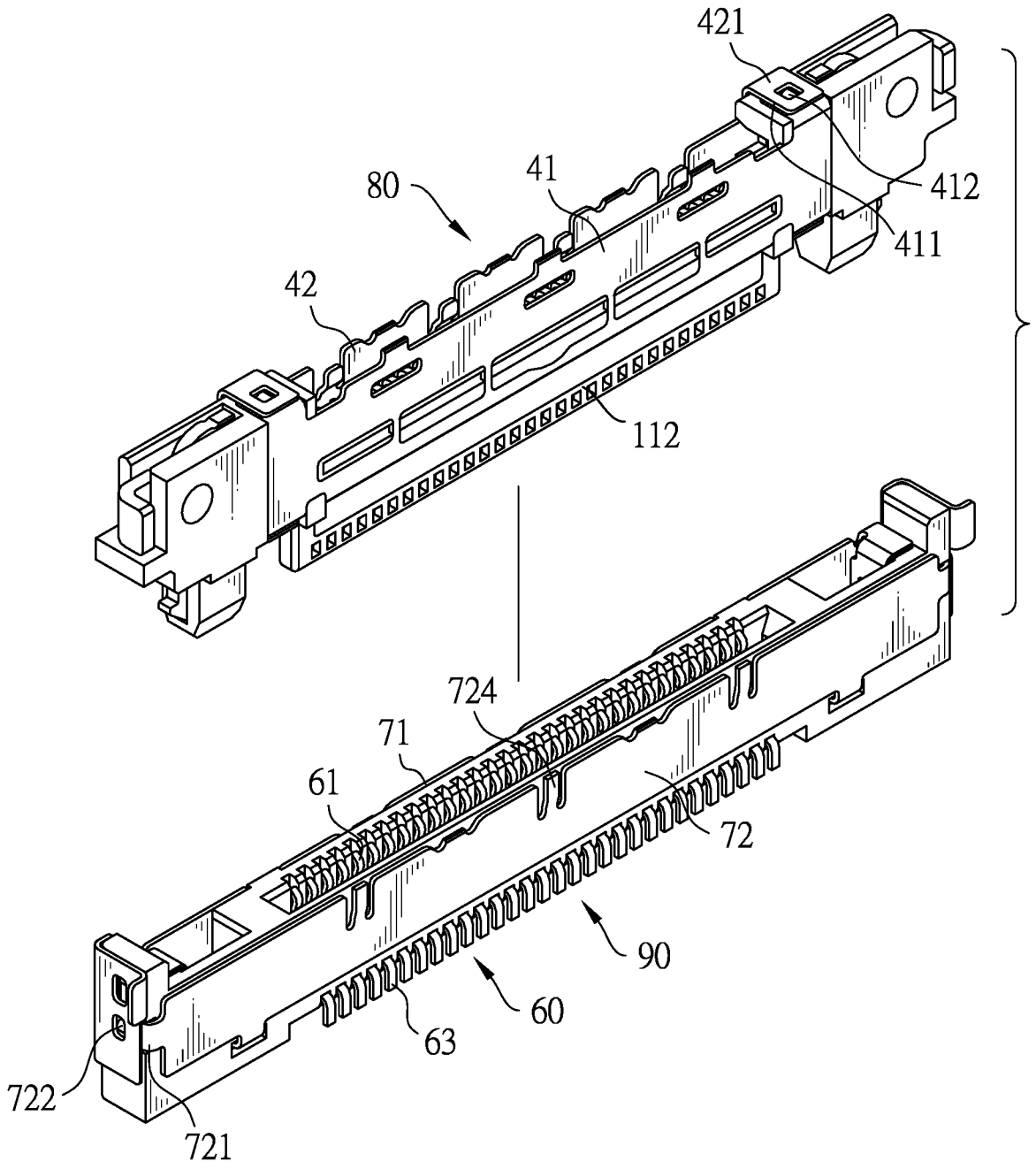
FIG. 4 is another exploded perspective view of the electrical plug connector and the electrical receptacle connector in FIG. 1.
Figure 5:
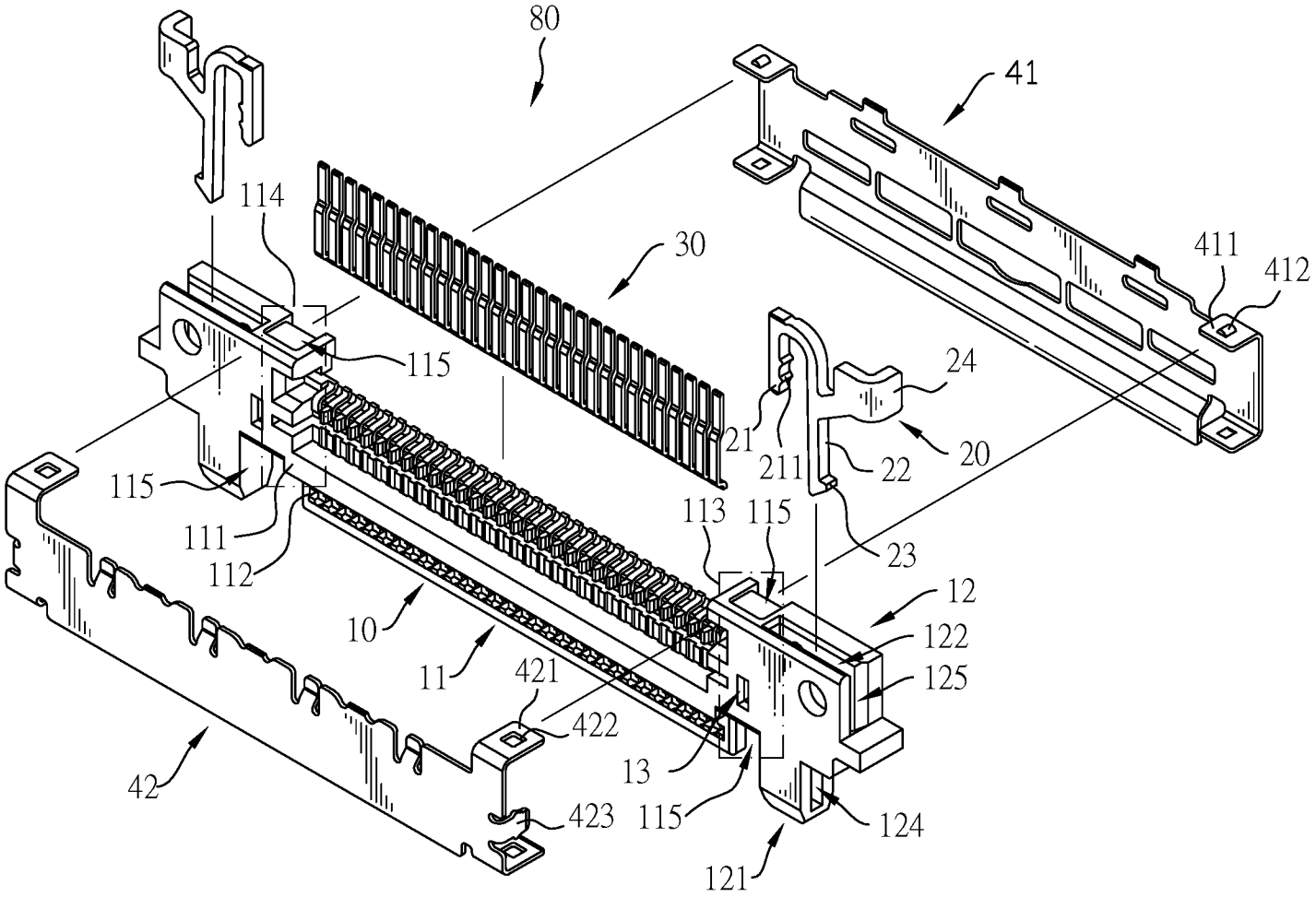
FIG. 5 is an exploded perspective view of the electrical plug connector in FIG. 1.
Figure 6:
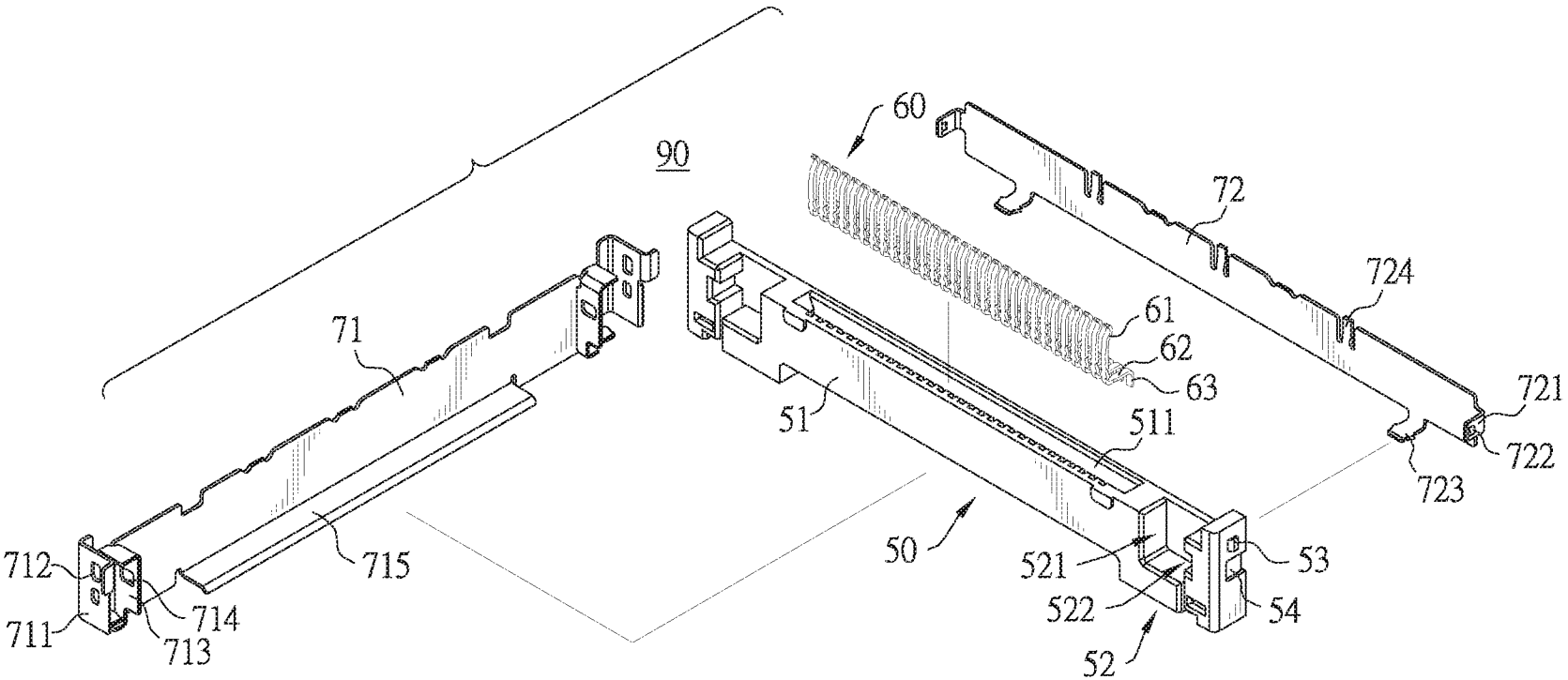
FIG. 6 is an exploded perspective view of the electrical receptacle connector in FIG. 1.

Referring to FIGS. 4, 6, and 9, the electrical receptacle connector 90 is detachably connected with the electrical plug connector 80. The electrical receptacle connector 90 has a receptacle insulated housing 50, multiple receptacle terminals 60, and a receptacle metallic shell.

The receptacle insulated housing 50 has an inserting portion 51 and two socket connecting portions 52 which are formed in long-and-thin shapes. The inserting portion 51 has a mounting slot 511 formed in a top surface of the inserting portion 51. The terminal portion 11 of the insulated housing 10 of the electrical plug connector 80 is detachably mounted in the mounting slot 511.

The inserting portion 51, which is formed in a long-and-thin shape, has a first end and a second end. The two receptacle connecting portions 52 are respectively formed at the first end and the second end of the inserting portion 51 to form the long-and-thin shape. Each receptacle connecting portion 52 has a guiding recess 521 and an engaging recess 522. The guiding recess 521 is formed in a top end of the corresponding receptacle connecting portion 52. The engaging recess 522 is formed in a side wall of the guiding recess 521.

In the embodiment, the engaging recess 522 is located at an inner surface of the guiding recess 521. The engaging recess 522 may be located at a front surface or a back surface of the guiding recess 521.

The two guiding pillars 121 of the electrical plug connector 80 are detachably mounted in the guiding recesses 521 of the two receptacle connecting portions 52. The engaging portions 23 of the two elastic buckle elements 20 detachably engage with the engaging recesses 522 of the two receptacle connecting portions 52.

The multiple receptacle terminals 60 are mounted in the mounting recess 511 of the receptacle insulated housing 50 along a longitudinal direction of the inserting portion 51 so as to form multipolar shapes at appropriate pitch intervals. The long-and-thin shaped inserting portion 51 is extending in a long-and-thin shape along the multipolar arrangement direction (the connector longitudinal direction) of the multiple receptacle terminals 60. The multiple receptacle terminals 60 include at least one signal terminal and at least one grounding terminal. In another embodiment, the multiple receptacle terminals 60 include at least one power supply terminal.

When the electrical plug connector 80 is mated with the electrical receptacle connector 90, the multiple plug terminals 30 may contact the multiple receptacle terminals 60 and are conducted with each other.

The receptacle plug metallic shell is connected with the receptacle insulated housing 50. In this embodiment, the receptacle plug metallic shell includes a third metallic shell 71 and a fourth metallic shell 72. The receptacle insulated housing 50 is covered between the third metallic shell 71 and the fourth metallic shell 72.

Each receptacle connecting portion 52 has a housing positioning block 53 and a positioning recess 54. The housing positioning block 53 protrudes from a side surface of the receptacle connecting portion 52. The positioning recess 54 is formed in the side surface of the receptacle connecting portion 52.

The fourth metallic shell 72 has two side surfaces, two fourth positioning sheets 721, and two fourth positioning blocks 722. The two fourth positioning sheets 721 respectively protrude from the two side surfaces of the fourth metallic shell 72. The two fourth positioning sheets 721 respectively are inserted into the positioning recesses 54 of the two receptacle connecting portions 52. The two fourth positioning blocks 722 respectively protrude from side surfaces of the two fourth positioning sheets 721.

The third metallic shell 71 has two side surfaces, two third positioning sheets 711, and two third positioning holes 712. The two third positioning sheets 711 protrude from the two side surfaces of the third metallic shell 71. The two third positioning holes 712 are respectively formed through the two third positioning sheets 711. Therefore, the third metallic shell 71 and the fourth metallic shell 72 can be combined together.

Furthermore, referring to FIG. 9, the receptacle insulated housing 50 has two receptacle inserting recesses 55. The two receptacle inserting recesses 55 are formed in a side surface of the receptacle insulated housing 50 and face the fourth metallic shell 72. The fourth metallic shell 72 has two lateral-side fixation plates 723. The two lateral-side fixation plates 723 protrude from a bottom edge of the fourth metallic shell 72 and face the receptacle insulated housing 50. The two lateral-side fixation plates 723 are respectively mounted in and fixed with the two receptacle inserting recesses 55, and the fourth metallic shell 72 and the insulated housing 50 can be combined together. In another embodiment, the number of the receptacle inserting recess 55 and the number of the fixed sheet 723 can be one or multiple.

Furthermore, the third metallic shell 71 has two side edges and two engaging sheets 713. The two engaging sheets 713 respectively protrude from the two side edges. The two engaging sheets 713 are respectively mounted in the two guiding recesses 521 of the receptacle insulated housing 50. Each engaging sheet 713 has an engaging hole 714 formed through the engaging sheet 713. The two elastic buckle elements 20 are respectively detachably engaged with the engaging holes 714 of the two engaging sheets 713. Therefore, the connection strength between the electrical plug connector 80 and the electrical receptacle connector 90 is enhanced.

Furthermore, the third metallic shell 71 has a bottom surface and a shelter sheet 715. The shelter sheet 715 protrudes from the bottom surface of the third metallic shell 71, and the shelter sheet 715 is below the multiple receptacle terminals 60. Specifically, each receptacle terminal 60 has an upper extending portion 61, a horizontal portion 62, and a lower extending portion 63. The upper extending portion 61 is upwardly bent at a front end of the horizontal portion 62, and the lower extending portion 63 is bent downwards at a rear end of the horizontal portion 62. The shelter sheet 715 shelters the horizontal portion 62 of each receptacle terminal 60 to block electromagnetic interference (EMI) and radio frequency interference (RFI).

Referring to FIGS. 4 and 6, the fourth metallic shell 72 has a top surface and three grounding sheets 724. The three grounding sheets 724 protrude from the top surface of the fourth metallic shell 72. The grounding sheets 724 can be used to contact the circuit board or the substrate to achieve the grounding effect. In use, the grounding sheets 724 can be optionally bent to connect with the circuit board or the substrate. In other embodiments, the number of the grounding sheet 724 can be one.

Figure 7:
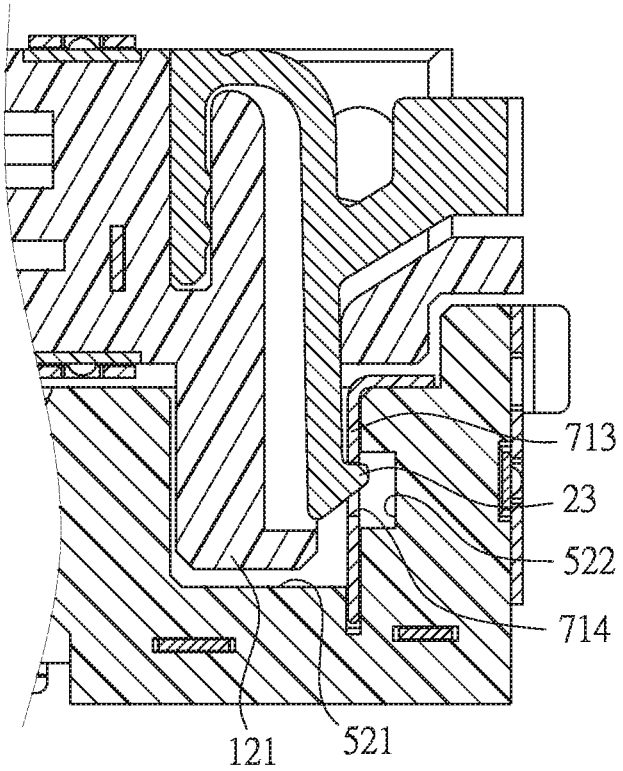
FIG. 7 is an enlarged operational cross sectional side view of the electrical plug connector and the electrical receptacle connector in FIG. 1.
Figure 8:
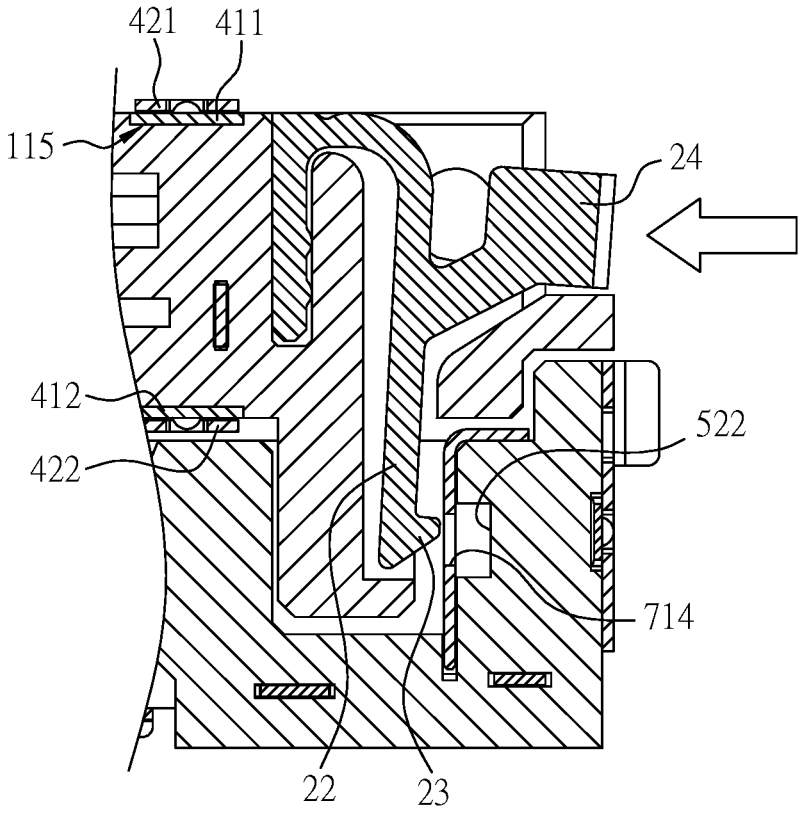
FIG. 8 is another enlarged operational cross sectional side view of the electrical plug connector and the electrical receptacle connector in FIG. 1.

Referring to FIGS. 7 to 9, the electrical plug connector 80 may be plugged in the electrical receptacle connector 90, and the alignment between the two guiding pillars 121 of the electrical plug connector 80 and the two guiding recesses 521 of the electrical receptacle connector 90 can provide a guiding effect to facilitate the assembly of the electrical plug connector 80 and the electrical receptacle connector 90.

In addition, after the two guiding pillars 121 are respectively inserted into the two guiding recesses 521, the engaging portions 23 of the two elastic buckle elements 20 may respectively engage with the two engaging recesses 522, thereby combining the electrical plug connector 80 and the electrical receptacle connector 90 together. When the electrical plug connector 80 is detached from the electrical receptacle connector 90, the pressing portions 24 of the two elastic engaging elements 20 are pressed to disengage the engaging portions 23 from the engaging recesses 522. The electrical plug connector 80 is then pulled upward to detach from the electrical receptacle connector 90.

The guiding pillars 121 are directly formed on the insulated housing 10, and the guiding recesses 521 are directly formed in the receptacle insulated housing 50. Therefore, the aforesaid effect can be achieved by simply attaching the two elastic buckle elements 20 to the plug insulated housing 10, so that the construction of the instant disclosure can be effectively simplified and thus the production cost can be reduced.

The electrical plug connector 80 is applied for connecting a coaxial cable and the electrical receptacle connector 90 is applied for connecting a circuit board or a substrate, and more specifically for use as a Type-C or other types of electrical connectors in a notebook computer. In this embodiment, the pin definition table of the plug terminal 30 of the electrical plug connector 80 and the receptacle terminals 60 of the electrical receptacle connector 90 is as follows:

| | coaxial | | cable | |
|---|---|---|---|---|
| No. | CABLINE-VSII 30P | | | Signal |
| 1 | COAX | <--> | COAX | Reserved |
| 2 | COAX | <--> | COAX | Reserved |
| 3 | COAX | <--> | COAX | Reserved |
| 4 | COAX | <--> | COAX | FORCE_PWR_GPIO |
| 5 | COAX | <--> | COAX | I2C_INT |
| 6 | COAX | <--> | COAX | SMBUS_SCL |
| 7 | COAX | <--> | COAX | SMBUS_SDA |
| 8 | GND | | GND | GND |
| 9 | COAX | <--> | COAX | SSTXp2 |
| 10 | COAX | <--> | COAX | SSTXn2 |
| 11 | GND | | GND | GND |
| 12 | COAX | <--> | COAX | SSRXp2 |
| 13 | COAX | <--> | COAX | SSRXn2 |
| 14 | GND | | GND | GND |
| 15 | COAX | <--> | COAX | USB2_D− |
| 16 | COAX | <--> | COAX | USB2_D+ |
| 17 | GND | | GND | GND |
| 18 | COAX | <--> | COAX | SSRXn1 |
| 19 | COAX | <--> | COAX | SSRXp1 |
| 20 | GND | | GND | GND |
| 21 | COAX | <--> | COAX | SSTXn1 |
| 22 | COAX | <--> | COAX | SSTXp1 |
| 23 | GND | | GND | GND |
| 24 | COAX | <--> | COAX | AUX+ |
| 25 | COAX | <--> | COAX | AUX− |
| 26 | COAX | <--> | COAX | LSTX |
| 27 | COAX | <--> | COAX | LSRX |
| 28 | COAX | <--> | COAX | Reserved |
| 29 | COAX | <--> | COAX | Reserved |
| 30 | COAX | <--> | COAX | Reserved |

The terminals numbers 4 to 7 and 24 to 27 may be adjusted to other signals or uses as required. The terminals numbers 8 to 23 are generally separated by five ground terminals to form five sets of signal terminals, wherein the terminals numbers 9, 10, 12, 13, 18, 19, 21, 22 are four sets of high-speed signal terminals, and the terminals numbers 15, 16 are one set of low-speed signal terminals.

Even though numerous characteristics and advantages of the instant disclosure have been set forth in the foregoing description, together with details of the structure and function of the instant disclosure, the disclosure is illustrative only, and changes may be made in detail, especially in matters of shape, size, and arrangement of parts within the principles of the instant disclosure to the full extent indicated by the broad general meaning of the terms in which the appended claims are expressed.

What is claimed is:

1. An electrical plug connector comprising:

an insulated housing extending in a long-and-thin shape along a connector longitudinal direction of the electrical plug connector and having:

a terminal portion having a base portion, a tongue portion, a first end portion and a second end portion, wherein the tongue portion is extended from a lower side of the base portion and is exposed to an exterior of the insulated housing, and the first end portion and the second end portion of the terminal portion are respectively defined at two lateral sides of the base portion, wherein a side surface of the first end portion and a side surface of the second end portion have two insertion slots, respectively; and a top and a bottom of the first end portion and a top and a bottom of the second end portion have four assembling grooves, respectively; and two connecting portions respectively formed at the first end portion and the second end portion of the terminal portion, such that the two connecting portions and the terminal portion are integrally formed as a single part, wherein and each connecting portion having:

a guiding pillar protruding from the connecting portion and having an opening, wherein the guiding pillars of the connecting portions are respectively parallel to two sides of the tongue portion and are respectively disposed apart from the tongue portion at the lateral sides of the base portion; and a receiving groove formed in the connecting portion and communicating with the opening;

two elastic buckle elements respectively mounted wholly in the receiving grooves of the two connecting portions, and each elastic buckle element having:

a fixed portion mounted at a corresponding one of the connecting portions;

a moving portion extending from a top end of the fixed portion; and an engaging portion extending from a bottom end of the moving portion and selectively protruding out from the opening of the guiding pillar of a corresponding one of the connecting portions according to the position of the moving portion, wherein the fixed portion, the moving portion and the engaging portion lie in a same plane, and the fixed portion, the moving portion and the engaging portion of each of the elastic buckle element have the same thickness in a thickness direction being perpendicular to said plane;

multiple plug terminals arranged on the terminal portion of the insulated housing along a longitudinal direction of the terminal portion and arranged between the first end portion and the second end portion, so as to form multipolar shapes at appropriate pitch intervals; and a plug metallic shell made of metal and mounted around the insulated housing, the two connecting portions and two elastic buckle elements are exposed out of the plug metallic shell, wherein the plug metallic shell further comprises:

a first metallic shell having:

two side ends;

two first positioning sheets protruding respectively from each the two side ends and extending toward the insulated housing and received in the assembling grooves of the first end portion and the second end portion, respectively; and four first positioning blocks protruding respectively from top surfaces of the first positioning sheets; and a second metallic shell having:

two side ends;

two clamping sheets respectively protruding from the two sides ends of the second metallic shell and mounted through and fixed with the insertion slots;

two second positioning sheets protruding respectively from each of the two side ends of the second metallic shell and extending toward the insulated housing; and four second positioning holes formed respectively through the second positioning sheets, and mounted respectively around the first positioning blocks of the first metallic shell.

2. The electrical plug connector as claimed in claim 1, wherein the opening in the guiding pillar of each connecting portion is located at a horizontal side surface of the guiding pillar of the connecting portion.

3. The electrical plug connector as claimed in claim 1, wherein the opening in the guiding pillar of each connecting portion is located on a lateral outer side of the guiding pillar of the connecting portion, and the engaging portion of each of the elastic buckle elements protrudes laterally outwards from the bottom end of the moving portion of the elastic buckle element.

4. The electrical plug connector as claimed in claim 1, wherein each connecting portion has a notch formed through a side surface of the connecting portion and communicating with the receiving groove in the connecting portion and each elastic buckle element has a pressing portion protruding from an outer side surface of the moving portion of the elastic buckle element, and extending out of the notch of a corresponding one of the connecting portions.

5. The electrical plug connector as claimed in claim 1, wherein each connecting portion has a fixing groove formed in the connecting portion and the fixed portion of each elastic buckle element is mounted at a corresponding one of the connecting portions and has a side surface and multiple abutting protruding portions protruding from the side surface of the fixed portion and abutting an inner surface of the fixing groove of a corresponding one of the connecting portions.

6. The electrical plug connector as claimed in claim 1, wherein the guiding pillar of each connecting portion has multiple inclined faces formed at a bottom surface of the guiding pillar and is tapered from a top to a bottom of the guiding pillar.

7. An electrical plug connector comprising:

an insulated housing extending in a long-and-thin shape along a connector longitudinal direction of the electrical plug connector and having:

a terminal portion having a base portion, a tongue portion, a first end portion and a second end portion, wherein the tongue portion is extended from a lower side of the base portion and is exposed to an exterior of the insulated housing, and the first end portion and the second end portion of the terminal portion are respectively defined at two lateral sides of the base portion, wherein a top and a bottom of the first end portion and a top and a bottom of the second end portion have four assembling grooves, respectively; and two connecting portions respectively formed at the first end portion and the second end portion of the terminal portion, such that the two connecting portions and the terminal portion are integrally formed as a single part, and each connecting portion having:

a guiding pillar protruding from the connecting portion and having an opening; and a receiving groove formed in the connecting portion and communicating with the opening;

two elastic buckle elements respectively mounted wholly in the receiving grooves of the two connecting portions, and each elastic buckle element having:

a fixed portion mounted at a corresponding one of the connecting portions;

a moving portion extending from a top end of the fixed portion; and an engaging portion extending from a bottom end of the moving portion and selectively protruding out from the opening of the guiding pillar of a corresponding one of the connecting portions according to the position of the moving portion, wherein the fixed portion, the moving portion and the engaging portion has the same thickness;

multiple plug terminals arranged on the terminal portion of the insulated housing along a longitudinal direction of the terminal portion and arranged between the first end portion and the second end portion so as to form multipolar shapes at appropriate pitch intervals, and a plug metallic shell made of metal and mounted around the insulated housing, the two connecting portions and two elastic buckle elements are exposed out of the plug metallic shell, wherein the plug metallic shell further comprises:

a first metallic shell having:

two side ends;

two first positioning sheets protruding respectively from each the two side ends and extending toward the insulated housing and received in the assembling grooves of the first end portion and the second end portion, respectively; and four first positioning blocks protruding respectively from top surfaces of the first positioning sheets; and a second metallic shell having:

two side ends;

two second positioning sheets protruding respectively from each of the two side ends of the second metallic shell and extending toward the insulated housing; and four second positioning holes formed respectively through the second positioning sheets, and mounted respectively around the first positioning blocks of the first metallic shell.

8. The electrical plug connector as claimed in claim 7, wherein the opening in the guiding pillar of each connecting portion is located at a horizontal side surface of the guiding pillar of the connecting portion.

9. The electrical plug connector as claimed in claim 7, wherein the opening in the guiding pillar of each connecting portion is located on a lateral outer side of the guiding pillar of the connecting portion, and the engaging portion of each of the elastic buckle elements protrudes laterally outwards from the bottom end of the moving portion of the elastic buckle element.

10. The electrical plug connector as claimed in claim 7, wherein each connecting portion has a notch formed through a side surface of the connecting portion and communicating with the receiving groove in the connecting portion and each elastic buckle element has a pressing portion protruding from an outer side surface of the moving portion of the elastic buckle element, and extending out of the notch of a corresponding one of the connecting portions.

11. The electrical plug connector as claimed in claim 7, wherein each connecting portion has a fixing groove formed in the connecting portion and the fixed portion of each elastic buckle element is mounted at a corresponding one of the connecting portions and has a side surface and multiple abutting protruding portions protruding from the side surface of the fixed portion and abutting an inner surface of the fixing groove of a corresponding one of the connecting portions.

12. The electrical plug connector as claimed in claim 7, wherein the guiding pillar of each connecting portion has multiple inclined faces formed at a bottom surface of the guiding pillar and is tapered from a top to a bottom of the guiding pillar.

13. The electrical plug connector as claimed in claim 7, wherein each of the first end portion and the second end portion of insulated housing has at least one insertion slot formed in a side surface of the insulated housing and the plug metallic shell has at least two clamping sheets at two sides of the plug metallic shell mounted through and fixed with the at least two insertion slots respectively.

14. An electrical plug connector comprising:

an insulated housing extending in a long-and-thin shape along a connector longitudinal direction of the electrical plug connector and having:

a terminal portion having a base portion, a tongue portion, a first end portion and a second end portion, wherein the tongue portion is extended from a lower side of the base portion and is exposed to an exterior of the insulated housing, the first end portion and the second end portion of the terminal portion are respectively defined at two lateral sides of the base portion, wherein a side surface of the first end portion and a side surface of the second end portion have two insertion slots, respectively; and a top and a bottom of the first end portion and a top and a bottom of the second end portion have four assembling grooves, respectively; and two connecting portions respectively formed at the first end and the second end of the terminal portion, such that the two connecting portions and the terminal portion are integrally formed as a single part, and each connecting portion having:

a guiding pillar protruding from the connecting portion and having an opening; and a receiving groove formed in the connecting portion and communicating with the opening;

two elastic buckle elements respectively mounted wholly in the receiving grooves of the two connecting portions, and each elastic buckle element having:

a fixed portion mounted at a corresponding one of the connecting portions;

a moving portion extending from a top end of the fixed portion; and an engaging portion extending from a bottom end of the moving portion and selectively protruding out from the opening of the guiding pillar of a corresponding one of the connecting portions according to the position of the moving portion, wherein the fixed portion, the moving portion and the engaging portion has the same thickness; and multiple plug terminals arranged on the terminal portion of the insulated housing along a longitudinal direction of the terminal portion so as to form multipolar shapes at appropriate pitch intervals; and a plug metallic shell made of metal and mounted around the insulated housing, the two connecting portions and two elastic buckle elements are exposed out of the plug metallic shell, wherein the plug metallic shell further comprises:

a first metallic shell having:

two side ends;

two first positioning sheets protruding respectively from each the two side ends and extending toward the insulated housing and received in the assembling grooves of the first end portion and the second end portion, respectively; and four first positioning blocks protruding respectively from top surfaces of the first positioning sheets; and a second metallic shell having:

two side ends;

two clamping sheets respectively protruding from the two sides ends of the second metallic shell and mounted through and fixed with the insertion slots;

two second positioning sheets protruding respectively from each of the two side ends of the second metallic shell and extending toward the insulated housing; and four second positioning holes formed respectively through the second positioning sheets, and mounted respectively around the first positioning blocks of the first metallic shell.

15. The electrical plug connector as claimed in claim 14, wherein the guiding pillars of the connecting portions are respectively parallel to two sides of the tongue portion and are respectively disposed apart from the tongue portion at the lateral sides of the base portion.

* * * * *